United States Patent [19]

Dassance et al.

[11] Patent Number: 5,027,636

[45] Date of Patent: Jul. 2, 1991

[54] FEEDER MECHANISM FOR APPLICATOR DIE

[75] Inventors: Donald A. Dassance, Cadillac; Richard E. Feldborg, Grosse Pointe, both of Mich.

[73] Assignee: ACU-Crimp, Inc., Mesick, Mich.

[21] Appl. No.: 571,326

[22] Filed: Aug. 22, 1990

Related U.S. Application Data

[63] Continuation-in-part of Ser. No. 418,501, Oct. 10, 1989, Pat. No. 4,959,988.

[51] Int. Cl.[5] ..... B21D 43/10; B21D 43/14; B21F 23/00; H01R 43/052

[52] U.S. Cl. ..... 72/423; 29/863

[58] Field of Search ..... 72/421, 423, 424, 361, 72/422; 198/803.3, 803.7, 803.8; 29/862, 863, 828

[56] References Cited

U.S. PATENT DOCUMENTS

| | | | |
|---|---|---|---|
| 3,686,752 | 8/1972 | Hammond | 29/862 |
| 3,703,954 | 11/1972 | Gudmestad | 198/803.7 |
| 3,789,485 | 2/1974 | Gudmestad | 29/862 |
| 4,135,378 | 1/1979 | Balon | 72/421 |
| 4,741,432 | 5/1988 | Dekko | 198/803.8 |
| 4,763,411 | 8/1988 | Takeshita | 29/863 |
| 4,899,441 | 2/1990 | Ricard | 29/863 |

*Primary Examiner*—Robert L. Spruill

*Attorney, Agent, or Firm*—Krass & Young

[57] ABSTRACT

A feeder mechanism for use with an applicator die in which a supply of terminals is fed to the die in the form of a plurality of interconnected terminals and the die functions to crimpingly apply a terminal to an end of each of a plurality of leads successively fed to the die and sever the terminals from the terminal strip. The feeder mechanism comprises a wheel mounted such that the periphery of the wheel moves proximate the applicator die and a plurality of lead receiving assemblies are positioned at circumferentially spaced intervals around the periphery of the wheel so that the wheel may be incrementally rotated to bring successive lead receiving assemblies into proximity to the applicator die so as to allow a terminal to be crimpingly secured to the lead brought to the applicator die by each successive assembly. Each assembly includes a clamp controlled by a lever so that an operator positioned at the entry side of the applicator die may place a lead in a nest defined by the assembly and clamp the lead in the nest whereafter the lead may be incrementally advanced to the applicator die for coaction with a terminal delivered to the die. As the crimped lead is moved away from the applicator die by incremental rotation of the wheel, a release bar engages the lever to move the clamp to a released position to allow the lead with the crimped terminal thereon to fall by gravity into a suitable collection bin.

19 Claims, 6 Drawing Sheets

FIG - 8
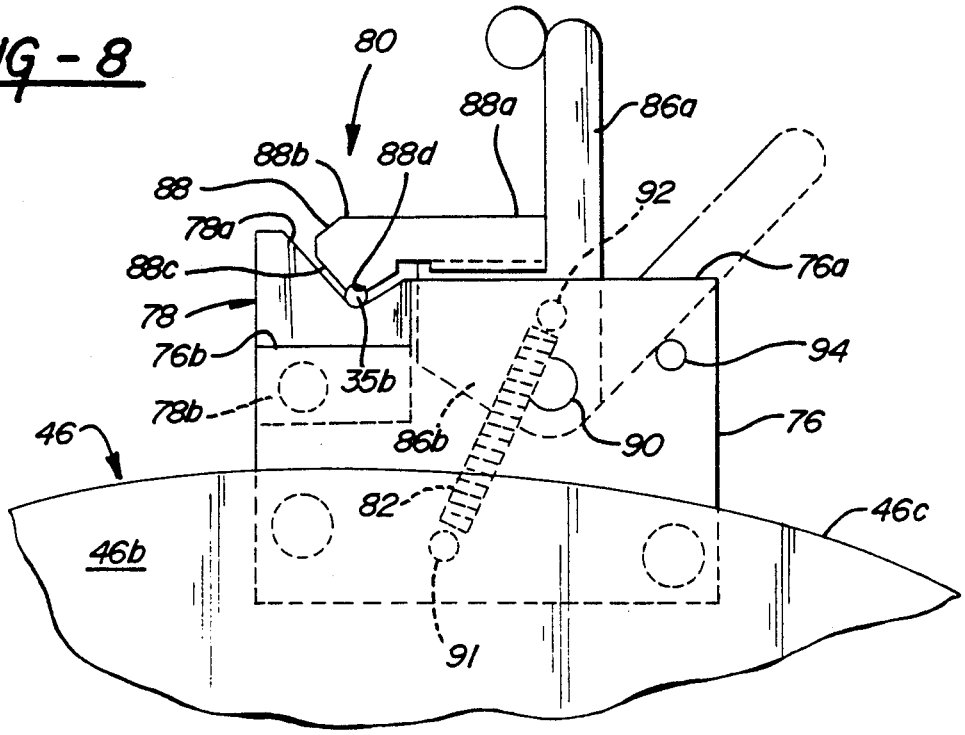
FIG - 10
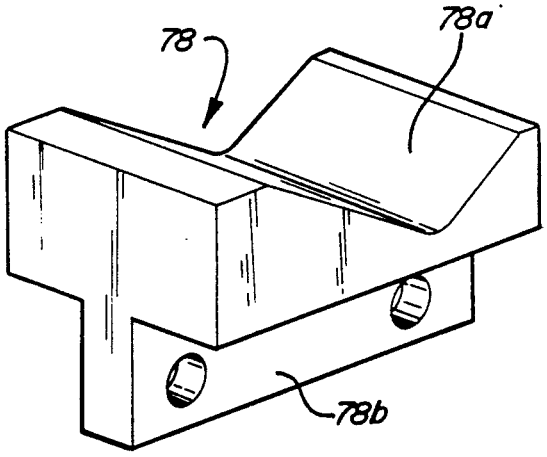
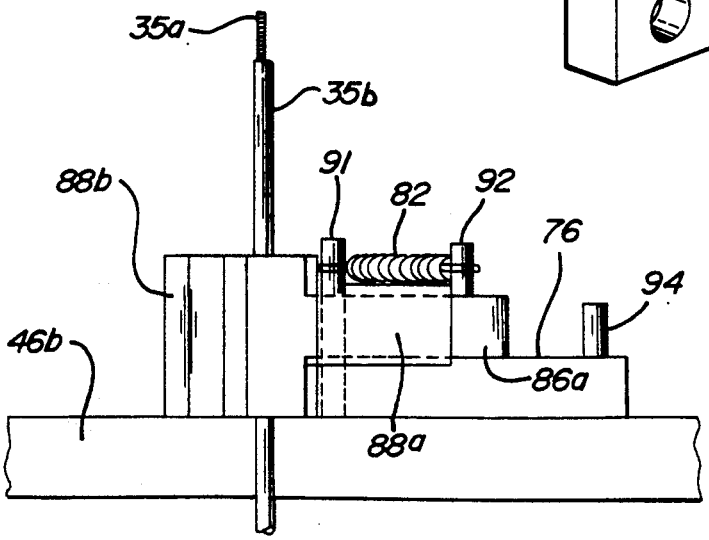
FIG - 9

FEEDER MECHANISM FOR APPLICATOR DIE

RELATED APPLICATION

This application is a continuation-in-part of U.S. patent application, Ser. No. 418,501 filed Oct. 10, 1989, now U.S. Pat. No. 4,959,988.

BACKGROUND OF THE INVENTION

This invention relates to applicator dies and more particularly to an applicator die for use with a press to form a crimping machine for crimpingly securing terminals to the ends of leads.

Modern industry requires vast quantities of electrical leads with terminals crimpingly secured to the ends of the lead and many forms of applicator dies have been devised to perform the required crimping operation. Typically, the terminals to be crimped to the ends of the lead are provided in the form of a terminal strip comprising a plurality of serially arranged, interconnected terminals. The leads are fed individually to the die, and the die functions to crimpingly apply a terminal to the end of each lead and sever the terminal from the terminal strip in a manner to produce a continuous series of leads each having a terminal crimpingly secured to the end of the lead.

The leads may be delivered to the die manually by an operator positioned at the die and feeding the leads individually to the die for each successive crimping operation; the leads may be delivered in a fully automated process whereby each lead is fed automatically to the die in timed relationship to a terminal strip arriving at the die; or the leads may be fed to the die by some manner of semiautomatic mechanism. Whereas fully automatic feed of the leads to the die is generally preferable, the mechanisms required to provide such a fully automatic feed are extremely complioated and expensive and it is often not economically feasible to design and provide a fully automatic feed mechanism for each particular job operation to be performed by the applicator die. Specifically, relatively low volume runs for the applicator die do not justify the design and provision of a fully automatic mechanism and yet it is desirable to automate the delivery of the leads to the die to some extent to minimize operator error and operator tedium.

SUMMARY OF THE INVENTION

This invention is directed to the provision of a semiautomatic feeder mechanism for an applicator die.

More particularly, this invention is directed to the provision of a feeder mechanism for an applicator die which is effective in operation but yet extremely simple and inexpensive in construction.

The feeder mechanism of the invention is for use with an applicator die of the type in which a supply of terminals are fed to the die in the form of a terminal strip comprising a plurality of serially arranged interconnected terminals and the die functions to crimpingly apply a terminal to an end of each of a plurality of leads successively fed to the die and sever the terminals from the terminal strip to produce a series of leads each having a terminal crimpingly secured to an end thereof. The invention feeder mechanism comprises carrier means defining a plurality of spaced points therealong and operative when moved to move the points along a path extending from a location at an entry side of the die to a location at a discharge side of the die; a lead receiving assembly at each point on the carrier and each including a clamping member movable between a clamping position in which a lead is fixedly but releasably secured in the lead receiving assembly and a released position in which a lead may be loaded into or unloaded from the assembly; and drive means operative to move the carrier and thereby move the lead receiving assemblies along the path to successively deliver leads to the die for crimping attachment of a terminal. This arrangement provides an effective means of delivering leads to the die employing a simple, inexpensive and low-maintenance mechanism.

According to a further feature of the invention, the path defined by the carrier includes a loading station at the entry side of the die, whereat a lead may be loaded into the respective lead receiving assembly and the clamping member of the lead receiving assembly may be moved to its clamping position to clampingly engage the lead; a crimping station at the die whereat a terminal may be crimpingly secured to the clamped lead; and a discharge station at the discharge side of the die whereat the clamping member may be moved to its released position to allow discharge of the lead and its crimpingly secured terminal. This arrangement provides positive and effective delivery of leads to and from the die in a simple and effective manner.

According to a further feature of the invention, each clamping member includes a clamping portion, sized and configured to engage a lead, and a lever portion; and the feeder mechanism includes means at the discharge station operative in response to movement of a lead receiving assembly therepast to engage the lever portion of the respective clamping member and move the member to its released position. This arrangement provides a simple and effective means of releasing a lead from the feeder mechanism after a terminal has been crimped thereto.

According to a further feature of the invention, the drive means is operative to incrementally advance the carrier with the respective load receiving assemblies being advanced to the die with each incremental movement of the carrier. This drive arrangement allows an operator positioned proximate the carrier an interval of time to load a lead into a lead receiving assembly for delivery to the die.

According to a further feature of the invention, the carrier comprises a wheel and the lead receiving assemblies are positioned at circumferentially spaced locations around the periphery of the wheel. This arrangement allows the use of simple rotary motion to move the lead receiving assemblies through their various stations.

According to a further feature of the invention, each lead receiving assembly includes a nest sized and configured to receive a lead with the clamping member in its released position and allow movement of the lead in the direction of its length; and the feeding mechanism further includes a target member positioned at the loading station in the path of lengthwise movement of a lead positioned in the nest of the lead receiving assembly located at the loading station. This arrangement allows the lead to be placed in the nest of the lead receiving assembly and moved in the direction of its length to engage the target, whereafter the clamping member may be moved to its clamped position and the carrier incrementally advanced to move the clamped lead toward the crimping station.

BRIEF DESCRIPTION OF THE DRAWINGS

FIGS. 8 and 9 are detailed fragmentary views of a lead receiving assembly employed in the invention feeder mechanism;

FIG. 10 is a perspective view of an element of a lead receiving assembly; and

DETAILED DESCRIPTION OF THE PREFERRED EMBODIMENT

Figure 2:
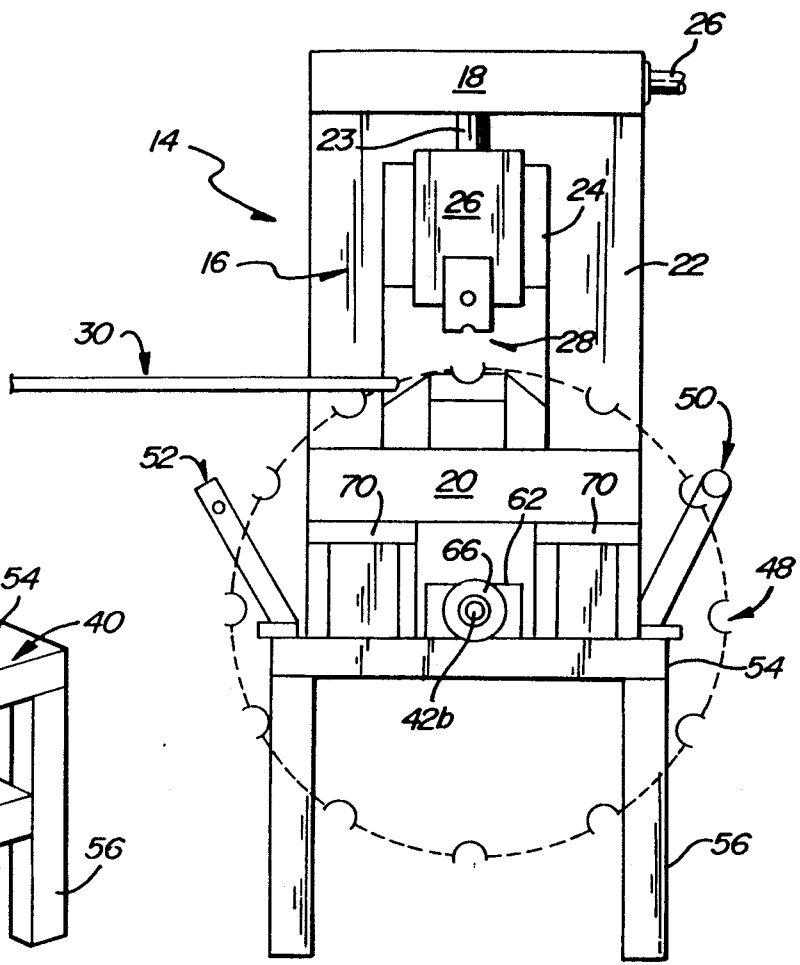
FIG. 2 is a front view of the crimping machine of FIG. 1.
Figure 1:
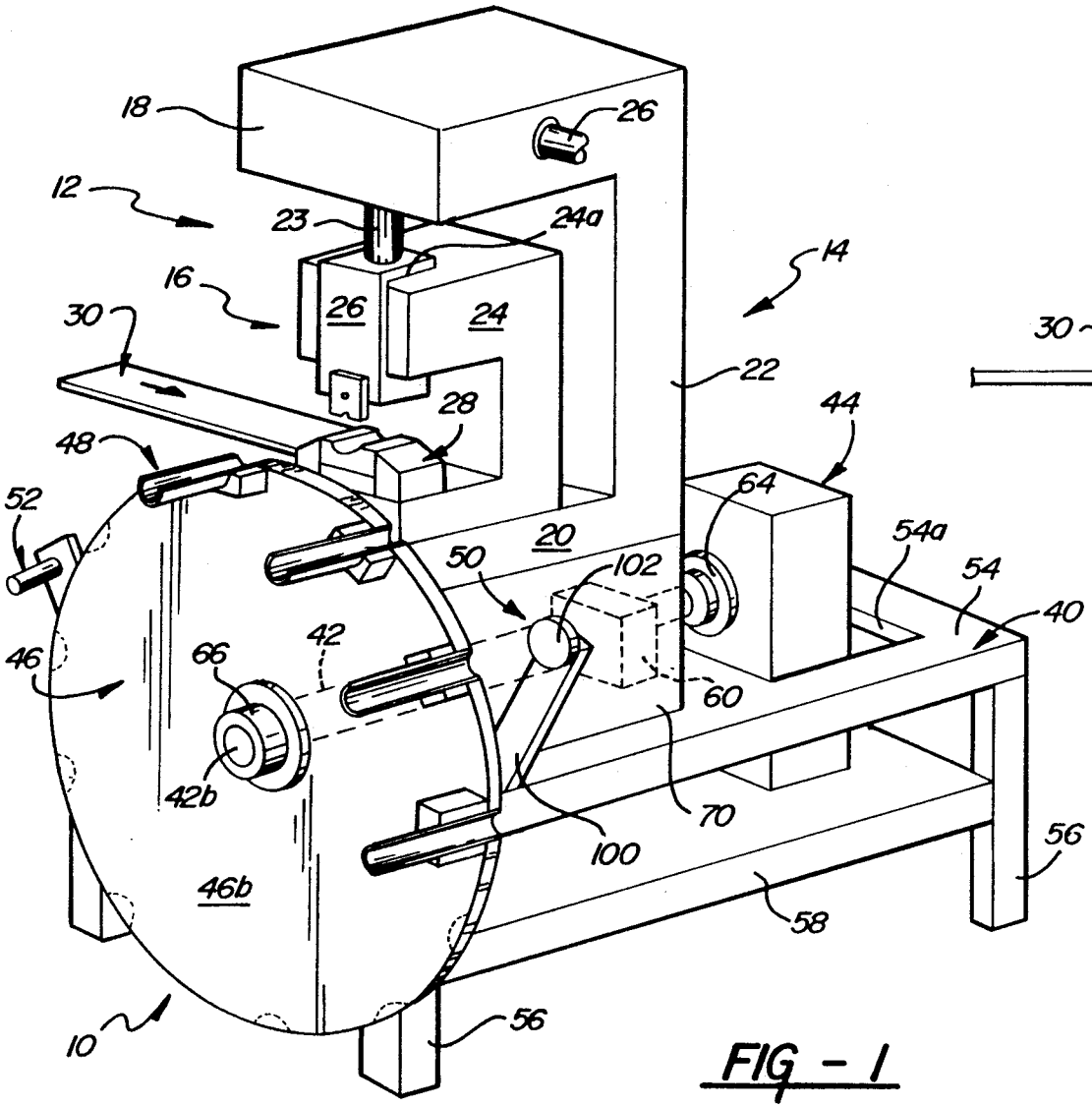
FIG. 1 is a perspective, somewhat schematic view of a crimping machine employing a feeder mechanism according to the invention.
Figure 3:
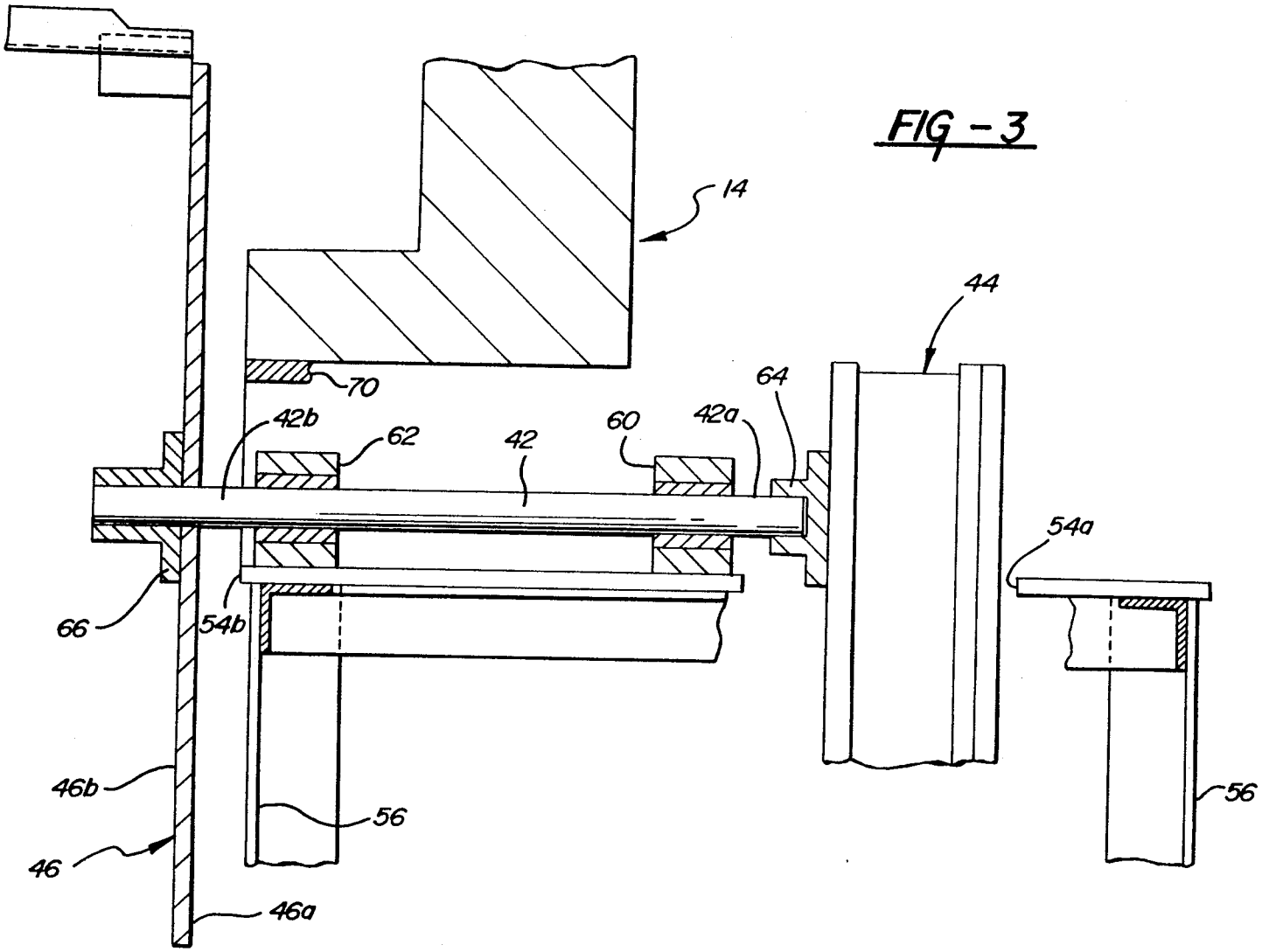
FIG. 3 is a fragmentary side view of the crimping machine of FIG. 1.

The invention feeder mechanism 10 is seen in FIG. 1 in association with a crimping machine 12 including a press 14 and an applicator die 16.

Press 14 is of known form and includes a head 18, a bed 20, a back structure 22 interconnecting the head and the bed, and a ram 23, shown schematically, mounted in known manner in the head 18 for powered reciprocal movement in response to rotation of an input crankshaft 26 so as to provide the power for die 16 positioned on the bed of the press.

Figures 4, 11:
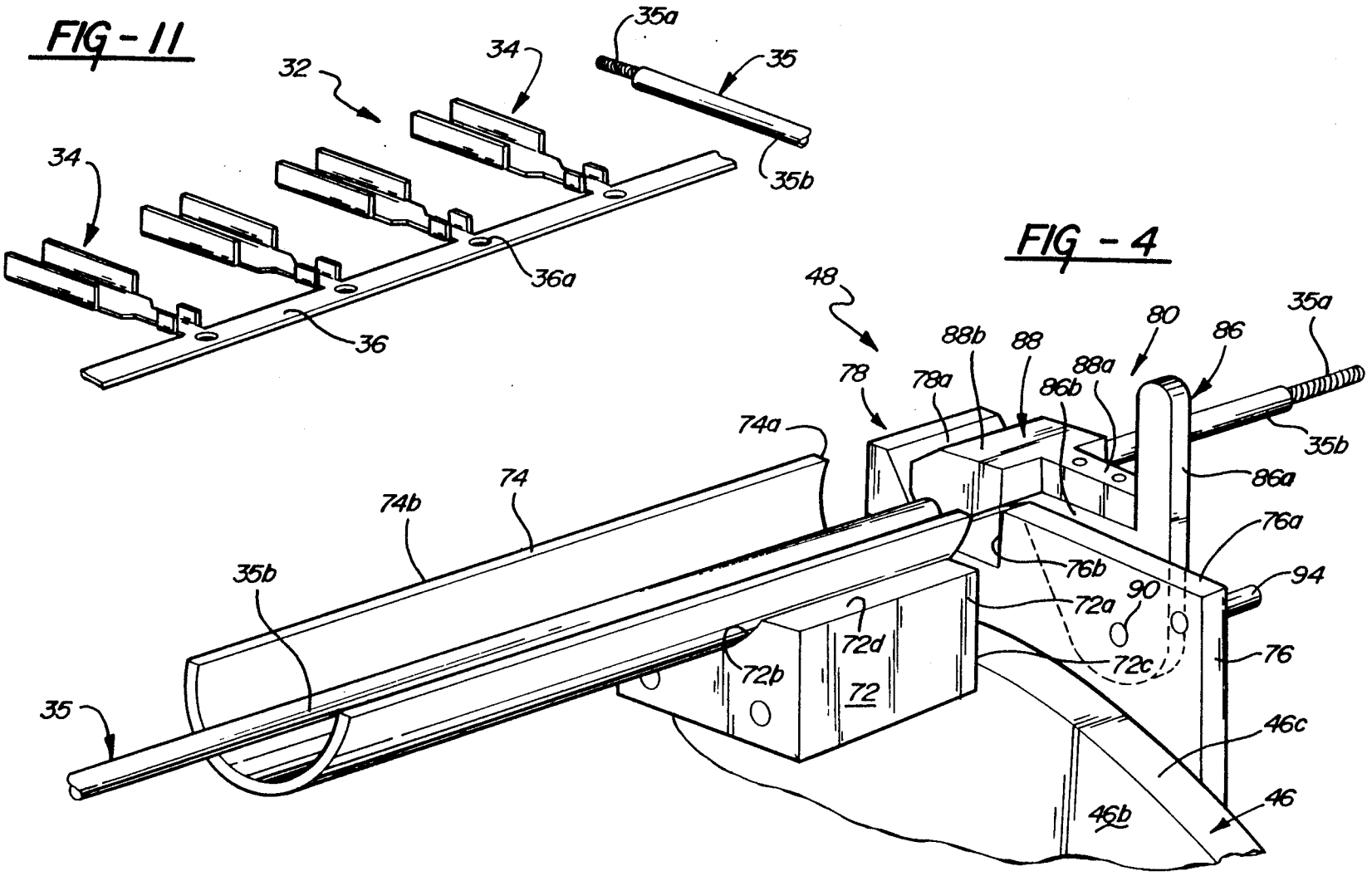
FIG. 4 is a fragmentary perspective view of a lead receiving assembly employed in the invention feeder mechanism.
FIG. 11 is a fragmentary perspective view of a terminal strip and lead.

Applicator die 16 includes a housing or frame 24; a slide 26 drivingly engaged at its upper end by the ram 23 and mounted for vertical reciprocal movement in a slideway **24*a* defined by housing 24; die means 28 of known form carried by the lower end of the slide and by the bed of the housing of the die and operative in known manner to crimpingly secure a terminal to a lead positioned within the die in response to downward movement of the slide as powered by the ram 24; and a feed structure 30 defining a generally horizontal feed path for feeding a terminal strip 32 (FIG. 11) to the die means 28 for successive application of the terminals to successive leads delivered to the die means. Terminal strip 32 may comprise, for example, a plurality of serially arranged interconnected terminals 34 respectively secured at one end thereof to successive points along a carrier band 36 with the carrier band including a drive hole 36*a* positioned opposite each terminal 34 for coaction in known manner with a feed finger of the applicator die 16. Applicator die 16** may, for example, be of the type shown in Applicant's U.S. patent application Ser. No. 418501 filed Oct. 10, 1989, now U.S. Pat. No. 4,959,988 but may also take other forms.

Feeder mechanism 10 comprises a table 40, a drive shaft 42, an intermittent drive assembly 44, a wheel 46, a plurality of lead receiving assemblies 48, a target assembly 50, and a release bar assembly 52.

Table 40 includes a top 54, legs 56, and a shelf 58.

Shaft 42 is arranged in parallel spaced relation above table top 54 by a pair of pillow blocks 60 and 62 respectively journalling the rear and front ends of the shaft and mounted on the table top 54. Shaft 42 will be seen to lie directly beneath the applicator die 16 and will be seen to extend in a direction perpendicular to the direction in which the terminals 34 are fed to the applicator die by terminal feed structure 30.

Incremental drive 44 drivingly engages the rear end **42*a* of drive shaft 42 via a hub 64 and is positioned within an opening 54*a* of table top 54 with the lower end of the drive mechanism supported on shelf 58. Incremental drive 44 may be of the type available, for example, from Jackson Machine Products of Madison Heights, Mich., as Index Table Model #T-8-12 and operates in known manner to impart incremental movement to shaft 42**.

Wheel 46 is secured to the forward end **42*b* of shaft 42 by a hub 66 with the rear face 46*a* of the wheel spaced forwardly from the front face 54*b* of table top 54**.

A pair of risers 70 are positioned on table top 54 at opposite sides of drive shaft 42 so as to support press 14 and applicator die 16 in a position directly overlying drive shaft 42 with the center line of the drive shaft lying in a common vertical plane with the center line of die means 28.

A plurality of lead receiving assemblies 48 are mounted at circumferentially spaced points around the periphery of wheel 46. In the embodiment illustrated, the assemblies 48 are spaced 30 degrees apart so that there are a total of 12 assemblies 48.

Each lead receiving assembly 48 includes a mounting block 72, a tubular wire nest 74, a mounting plate 76, a lead nest block 78, a clamp assembly 80, and a spring 82.

Mounting block 72 is suitably secured to the front face **46*b* of the wheel, as by screws or the like, adjacent the periphery of the wheel with the upper portion 72*a* of the block projecting radially beyond the periphery 46*c* of the wheel. Block 72 defines a saddle 72*b*** extending parallel to the axis of rotation of the wheel.

Tubular wire nest 74 has a generally tubular semicircular configuration and is positioned in saddle **72*b* with its rear edge 74*a* generally flush with the rear edge 72*c* of block 72 and with the upper portion 74*b* of the nest projecting above the upper face 72*d* of block 72**.

Mounting plate 76 has a generally rectangular configuration and is secured by screws or the like to the rear face **46*a* of the wheel in opposing relation to block 72 and with the upper portion 76*a* of the plate projecting radially beyond the periphery 46*c*** of the wheel.

Lead nest block 78 is positioned in a cut out **76*b* in mounting plate 76 and includes a clamping or nest portion 78*a* and a central mounting flange portion 78*b* secured to the rear face of plate 76** to mount the lead nest block to the mounting plate.

Clamp assembly 80 includes a lever 86 and a clamp 88.

Lever 86 includes a handle portion **86*a* and a mounting portion 86*b* and is pivotally mounted to the rear face of mounting plate 76 by a shoulder screw 90** so as to enable the lever to move pivotally relative to the mounting plate.

Clamp 88 is secured to the upper face of mounting portion **86*b* of lever 86 by screws or the like and includes a central mounting portion 88*a* and a clamp portion 88*b*. Clamp portion 88*b* has a convex face 88*c* generally matching the concave face of the nest portion 78*a* of lead nest block 78 and further defines a notch 88*d* sized to clampingly engage the insulated portion 35*b* of a lead 35 and clamp the lead against nest portion 78***a* of lead nest block 78.

Spring 82 extends between a pin 91 carried by the rear face of mounting block 86 and a pin 92 carried by the rear face of lever 86 and, as best seen in FIG. 8, is arranged in an over center relationship with respect to the pivotal axis of lever 86 so that as lever 86 is moved between the solid line clamping position of FIG. 8 and the dotted line released position of FIG. 8, the spring moves over center and acts in both positions to bias the lever toward the respective position. The released position of the lever is defined and delimited by a stop pin 94 carried on the rear face of mounting block 76.

Target assembly 50 includes a bracket 100 extending upwardly and outwardly from table top 54 and a target 102 of disc configuration secured to the radially outer end of bracket 100 by a screw 104 integral with the target so that the distance of the target 102 from the bracket may be selectively adjusted by threading movement of the target relative to the bracket. Target 102 is positioned 60 degrees before the top dead center position of the wheel opposite die means 28.

Release bar assembly 52 includes a bracket 106 extending upwardly and outwardly from table top 54 in opposed relation to target assembly bracket 100 and a release bar 108 secured to the outboard end of bracket 106 and extending forwardly from the front face 106*a* of the bracket. Bar 108 is positioned between 60 degrees and 90degrees past the top dead center position of the wheel.

It will be understood that incremental drive mechanism 44 operates in timed relationship to the operation of the applicator die to move the wheel 46 through a predetermined increment of rotation. In the embodiment disclosed, and as previously indicated, the lead receiving assemblies 48 are positioned at 30 degree intervals about the wheel and the wheel is moved through a 30 degree increment with each actuation of the drive mechanism 44. The feed mechanism is initially indexed so that a lead receiving assembly 48 is positioned 60 degrees before top dead center in direct opposition to target 102; a further lead assembly 48 is positioned at top dead center in direct opposition to the die means 28; and the release bar 108 is positioned between a pair of lead receiving assemblies positioned respectively 60 degrees and 90 degrees past top dead center.

Figure 5:
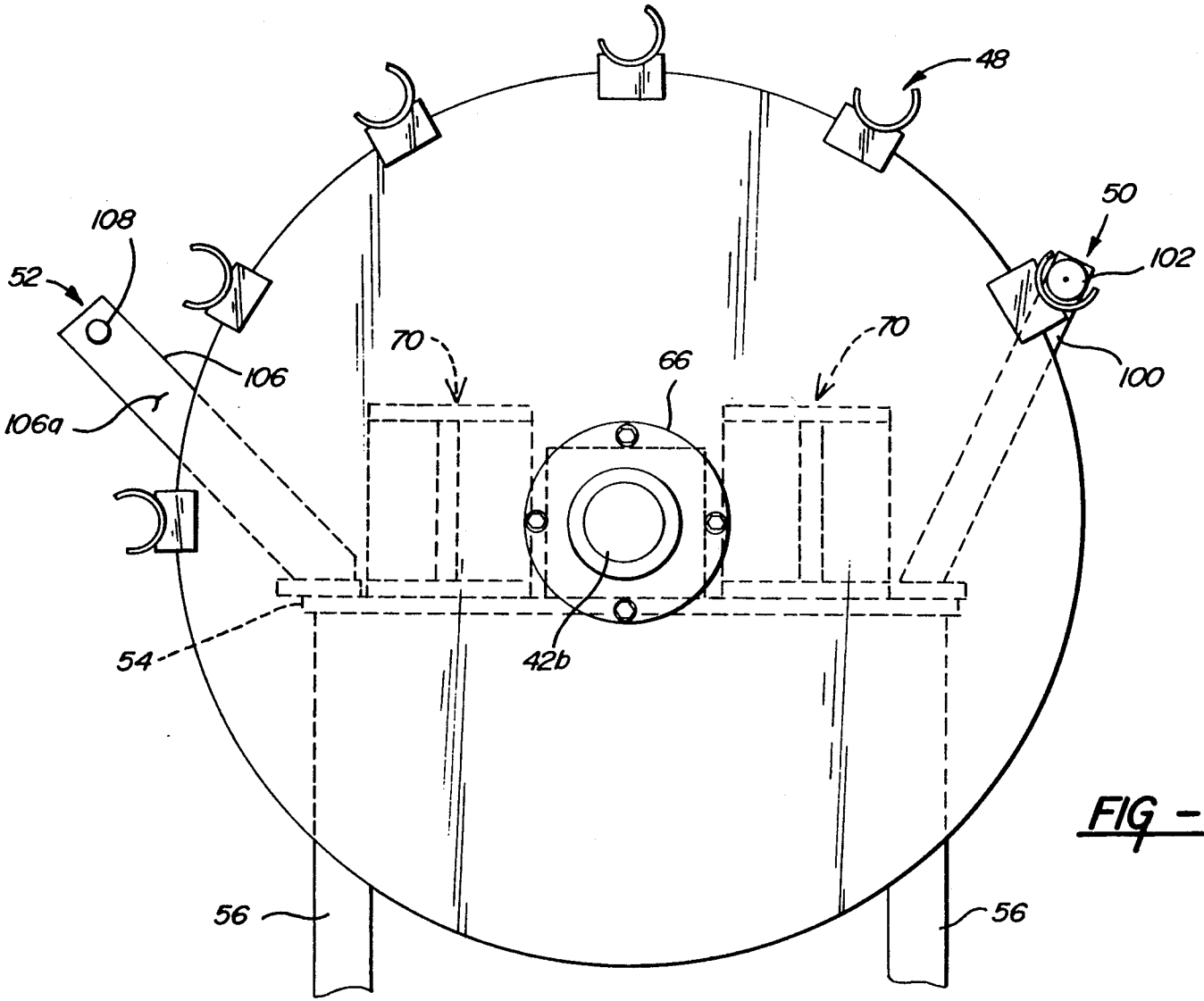
FIG. 5 is a somewhat schematic front view of the invention feeder mechanism.
Figure 6:
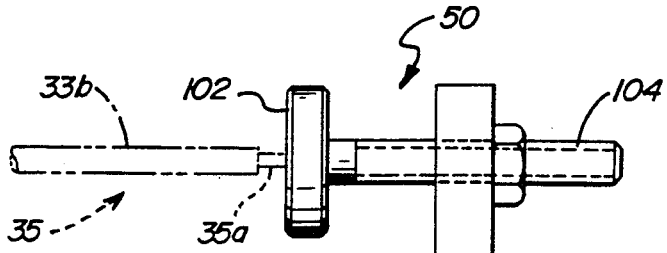
FIG. 6 is a view of a target utilized in the invention feeder mechanism.
Figure 7:
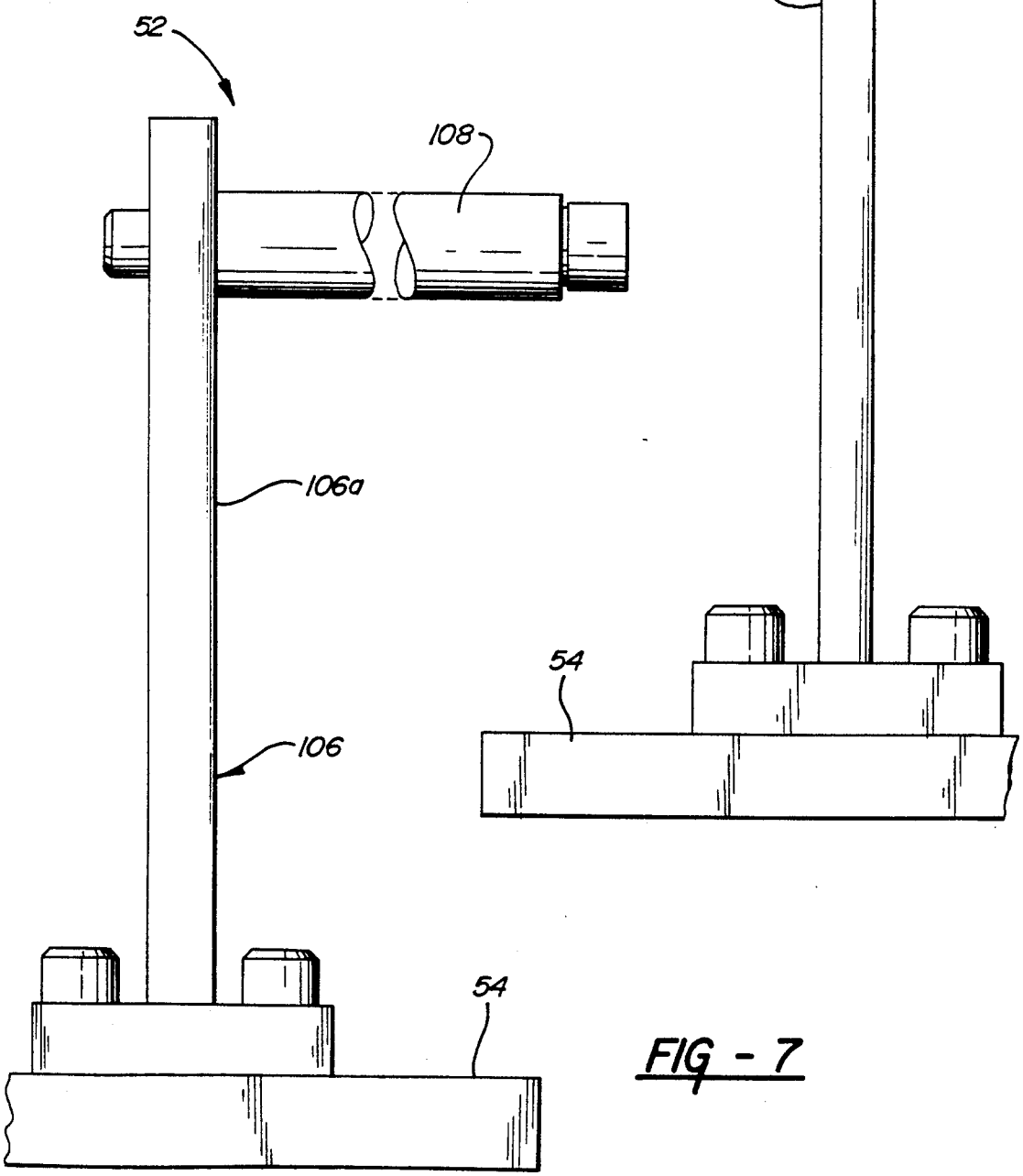
FIG. 7 is a view of a release mechanism utilized in the invention feed mechanism.

In operation, with the wheel positioned as seen in FIG. 5, an operator positioned at the target or loading station places a lead 35 in the tubular nest 74 and in the nest portion 78*a* of lead nest block 78 with lever 86 in its released position and moves the lead lengthwise within the nest in the direction of the length of the lead until the leading tip of the exposed portion 35*a* of the lead contacts the front face of the target 102 to indicate to the operator that the lead has assumed its proper predetermined extension with respect to the rear face 46*a* of the wheel. The operator now moves the lever 86 to its clamping position in which the notch 88*d* of the clamp portion 88*b* of the clamp 88 coacts with the saddle of portion 78*a* of lead nest block 78 to clamp the lead therebetween.

The operator will typically be given a predetermined interval of time to position the lead within the lead receiving assembly and move the clamp to its clamped position (for example, 10 seconds) whereafter the applicator die will be automatically actuated to crimp a terminal to the lead 35 positioned in the lead receiving assembly opposite the die means and drive 44 will be actuated to move the wheel through an increment of rotation so that each lead receiving assembly is advanced 30 degrees, whereupon the wheel is again stopped and the operator again has an interval (for example 10 seconds) to position and clamp a new lead in the new lead receiving assembly now positioned opposite target 102 whereafter the applicator die is again actuated to crimp a terminal to the lead now positioned opposite the die means and drive means 44 is again actuated to advance all of the lead receiving assemblies through a further 30 degree increment. As a lead receiving assembly 48 moves between its position 60 degrees past top dead center toward its position 90 degrees past top dead center, the lever portion 86*a* of the lever 86 of that lead receiving assembly is engaged by release bar 108 to move the lever to its open position against the action of over center spring 82 and to allow the crimped lead clamped in the lead receiving assembly to be released by gravity from the lead receiving assembly and fall into a suitable collection bin. It will be understood that each time the slide 26 of the applicator die moves downwardly to begin a crimping operation, the feed mechanism of the applicator die operates to advance the terminal strip 32 to move a terminal 34 into a position in the die immediately beneath an already present lead 35 so that continued downward movement of the slide results in the terminal being crimped to the lead and thereafter severed from the carrier strip 36.

The operation may, as described, be automatic in the sense that the wheel is advanced after a predetermined time interval or the machine may be set up such that the operator controls a switch which, when actuated, causes the applicator die 16 and feeder mechanism 10 to move through an operational cycle.

The disclosed feeder mechanism will be seen to provide a simple, inexpensive, and low-maintenance mechanism for delivering leads to the applicator die in a positive, precise manner. The invention feeder mechanism is therefor imminently suitable for situations in which the particular job being performed does not have a high enough volume to justify design and fabrication of a fully automatic feeder mechanism.

Whereas a preferred embodiment of the invention has been illustrated and described in detail, it will be apparent that various changes may be made in the disclosed embodiment without departing from the scope or spirit of the invention.

We claim:

1. For use with an applicator die of the type in which a supply of terminals is fed to the die in the form of a terminal strip comprising a plurality of serially arranged interconnected terminals and the die functions to crimpingly apply a terminal to an end of each of a plurality of leads successively fed to the die and sever the terminals from the terminal strip to produce a series of leads each having a terminal crimpingly secured to an end thereof, a feeder mechanism for feeding the leads successively to the die comprising:

carrier means defining a plurality of spaced points therealong and operative when moved to move said points along a path extending from a location at an entry side of said die and past said die to a location at a discharge side of said die;

a lead receiving assembly at each of said points on said carrier and each including an elongated nest extending in a direction normal to said path for receiving and supporting a lead while allowing movement of the lead in the direction of its length and a clamp assembly positioned proximate one end of said nest and including a clamp member movable between a clamping position in which a lead positioned in said nest is fixedly but releasably secured in the lead receiving assembly and a released position in which a lead may be loaded into or unloaded from the nest; and drive means operative to move said carrier and thereby move said lead receiving assemblies along said path to successively deliver leads to said die for crimping attachment of a terminal.

2. A feeder mechanism according to claim 1 wherein:

said path includes a load receiving station at the entry side of said die whereat a lead may be loaded into the respective lead receiving assembly and the clamp member of the lead receiving assembly may be moved to its clamping position to clampingly engage the lead, a crimping station at said die whereat a terminal may be crimpingly secured to the clamped lead, and a discharge station at the discharge side of said die whereat the clamp member may be moved to its released position to allow discharge of the lead and its crimpingly secured terminal from the lead receiving assembly.

3. A feeder mechanism according to claim 2 wherein:

each clamp member includes a clamping portion sized and configured to engage a lead positioned in said nest and a lever portion; and said feeder mechanism includes means at said, discharge station operative in response to movement of a lead receiving assembly therepast to engage the lever portion of the respective clamp member and move the clamp member to its released position.

4. A feeder mechanism according to claim 2 wherein:

said drive means are operative to incrementally advance said carrier with a respective lead receiving assembly being advanced to said die with each incremental movement of the carrier.

5. A feeder mechanism according to claim 2 wherein:

said carrier comprises a wheel; and said lead receiving assemblies are positioned at circumferentially spaced locations on said wheel.

6. A feeder mechanism according to claim 5 wherein:

said drive means are operative to incrementally rotate said wheel with a respective lead receiving assembly being advanced to said die with each incremental rotation of the wheel.

7. A feeder mechanism according to claim 6 wherein:

each clamp member includes a clamping portion sized and configured to engage a lead and a lever portion; and said feeder mechanism includes means at said discharge station operative in response to movement of a lead receiving assembly therepast to engage the lever portion of the respective clamp member and move the clamp member to its released position.

8. A feeder mechanism according to claim 7 wherein:

said mechanism further includes a spring arranged in an over center manner with respect to the movement of the clamp member between its clamping and released positions so as to bias the clamp member toward each of its positions.

9. A feeder mechanism according to claim 2 wherein:

said feeder mechanism further includes a target member positioned at said loading station in the path of lengthwise movement of a lead positioned in the nest of the lead receiving assembly located at said loading station, whereby to allow the lead to be placed in the nest of the lead receiving assembly and moved in the direction of its length to engage said target whereafter said clamp member may be moved to its clamping position and the carrier advanced to move the clamped lead toward the crimping station.

10. A feeder assembly according to claim 9 wherein:

each clamp member includes a clamping portion sized and configured to engage a lead and a lever portion; and said feeder mechanism includes means at said discharge station operative in response to movement of a lead receiving assembly therepast to engage the lever portion of the respective clamp member and move the clamp member to its released position.

11. For use with an applicator die of the type in which a supply of terminals is fed to the die in the form of a terminal strip comprising a plurality of serially arranged interconnected terminals and the die functions to crimpingly apply a terminal to an end of each of a plurality of leads successively fed to the die and sever the terminals from the terminal strip to produce a series of leads each having a terminal crimpingly secured to an end thereof, a feeder mechanism for feeding the leads successively to the die comprising;

a support structure;

a wheel mounted on said support structure for rotation about its central axis and arranged relative to said die so that points along the circumference of the wheel are successively brought into proximately to the die;

means for incrementally rotating said wheel; and a plurality of lead receiving assemblies secured to said wheel at circumferentially spaced points on the periphery of said wheel and each including an elongated nest extending in a direction parallel to said axis for receiving and supporting a lead while allowing movement of the lead in the direction of its length and a clamp assembly positioned proximate one end of said nest and including a clamp member movable between a clamping position in which a lead positioned in said nest is fixedly but releasably secured in the lead receiving assembly and a released positioned in which a lead may be loaded into or unloaded from the nest.

12. A feed mechanism according to claim 11 wherein:

the periphery of said wheel is mounted for movement along a path which includes a loading station at the entry side of said die whereat a lead may be loaded into their respective lead receiving assembly and the clamp member of the lead receiving assembly may be moved to its clamping position to clampingly engage the lead; a crimping station at the die whereat a terminal may be crimpingly secured to the clamped lead; and a discharge station at the discharge side of the die whereat the clamp member may be moved to its released position to allow discharge of the lead and its crimpingly secured terminal.

13. A feeder mechanism according to claim 12 wherein:

each clamp member includes a clamping portion sized and configured to engage a lead and a lever portion; and said feeder mechanism includes means at said discharge station operative in response to movement of a lead receiving assembly therepast to engage the lever portion of the respective clamp member and move the clamp member to its released position.

14. In an applicator die of the type in which a supply of terminals is fed to the die in the form of a terminal strip comprising a plurality of serially arranged interconnected terminals, a feeder mechanism functions to feed individual leads to the die, and the die functions to crimpingly apply a terminal to an end of each of the leads and sever the terminals from the terminal strip to produce a series of leads each having a terminal crimpingly secured to an end thereof, the improvement wherein said feed mechanism comprises:

carrier means defining a plurality of spaced points therealong and operative when moved to move said points along a path extending from a location at an entry side of said die and past said die to a location at a discharge side of said die;

a lead receivng assembly at each said point on said carrier and each including an elongated nest extending in a direction normal to said path for receiving and supporting a lead while allowing movement of the lead in the direction of its length and a clamp assembly positioned proximate one end of said nest and including a clamp member movable between a clamping position in which a lead positioned in said nest is fixedly but releasably secured in the lead receiving assembly and a released position in which a lead may be loaded into or unloaded from the nest; and drive means operative to move said carrier and thereby move said lead receiving assemblies along said path to successively deliver leads to said die for crimping attachment of a terminal.

15. An applicator die according to claim 14 wherein:

said path includes a loading station at the entry side of said die whereat a lead may be loaded into the respective lead receiving assembly and the clamp member of the lead receiving assembly may be moved to its clamping position to clampingly engage the lead, a crimping station at said die whereat a terminal may be crimpingly secured to the clamped lead, and a discharge station at the discharge side of said die whereat the clamp member may be moved to its released position to allow discharge of the lead and its crimpingly secured terminal.

16. An applicator die according to claim 15 wherein:

each clamp member includes a clamping portion sized and configured to engage a lead and a lever portion; and said feeder mechanism includes means at said discharge station operative in response to movement of a lead receiving assembly therepast to engage the lever portion of the respective clamp member and move the clamp member to its released position.

17. An applicator die according to claim 16 wherein:

said drive means are operative to incrementally advance said carrier with a respective lead receiving assembly being advanced to said die with each incremental movement of the carrier.

18. An applicator die according to claim 17 wherein:

said carrier comprises a wheel; and said lead receiving assemblies are positioned at circumferentially spaced locations on the periphery of said wheel.

19. An applicator die according to claim 18 wherein:

said feeder mechanism further includes a target member positioned at said loading station in the path of lengthwise movement of a lead positioned in the nest of the lead receiving assembly located at said loading station whereby to allow the lead to the placed in the nest of the lead receiving assembly and moved in the direction of its length to engage said target whereafter said clamp member may be moved to its clamped position and the carrier incrementally advanced to move the clamp lead toward the crimping station.

* * * * *